US007555992B1

(12) United States Patent
McCaughan

(10) Patent No.: US 7,555,992 B1
(45) Date of Patent: Jul. 7, 2009

(54) STABILIZER APPARATUS AND METHOD

(76) Inventor: Mark McCaughan, 4820 Woodside Dr., Anacortes, WA (US) 98221

( * ) Notice: Subject to any disclaimer, the term of this patent is extended or adjusted under 35 U.S.C. 154(b) by 0 days.

(21) Appl. No.: 11/712,326

(22) Filed: Feb. 28, 2007

(51) Int. Cl.
*B63B 39/00* (2006.01)
*B63B 39/06* (2006.01)

(52) U.S. Cl. ..... 114/121; 114/126

(58) Field of Classification Search ..... 114/121, 114/126, 282, 123, 138–142, 283
See application file for complete search history.

(56) References Cited

U.S. PATENT DOCUMENTS 3,931,781 A * 1/1976 Larsh ..... 114/126
4,041,885 A * 8/1977 Garcia ..... 114/126
4,266,496 A * 5/1981 Carlsen ..... 114/126
4,377,123 A * 3/1983 Jackson ..... 114/126
5,205,234 A * 4/1993 Schoell ..... 114/210

FOREIGN PATENT DOCUMENTS

FR 2720999 A1 * 12/1995

* cited by examiner

*Primary Examiner*—Ajay Vasudeva
(74) *Attorney, Agent, or Firm*—J. Nevin Shaffer, Jr.

(57) ABSTRACT

In a water craft, a stabilizer apparatus and method includes a stabilizer surface with a retractable arm connected with the stabilizer surface. An extension/retractor is connected with the retractable arm for extending and retracting the retractable arm beneath the water craft.

12 Claims, 2 Drawing Sheets

STABILIZER APPARATUS AND METHOD

FIELD OF THE INVENTION

This invention relates to a stabilizer apparatus and method. In particular in accordance with one embodiment the invention relates in water craft to a stabilizer apparatus including a stabilizer surface with a retractable arm connected with the stabilizer surface. An extension/retractor is connected with the retractable arm for extending and retracting the retractable arm beneath the water craft.

BACKGROUND OF THE INVENTION

The problem of stability has been an issue since the very first water craft was floated. Even when anchored, water craft respond to the environment and move when the water does. A variety of prior art attempts to address the issue include, for example, the additions of permanent out riders or pontoons on the sides of the water craft, long bulbous noses on the bow of the water craft, sea anchors or sails dragged behind water craft and multiple anchors set from various points of a water craft.

A problem with these prior art devices is that they are typically cumbersome and awkward to deploy. Further, they are often only useable in one situation, under weigh, or the other, at anchor, but not both. Additionally, they are often mechanically complex and, therefore, subject to break downs and malfunctions just when they are needed the most.

Thus, there is a need in the art for a stabilizer for water craft that is easy to use, inexpensive and mechanically robust. It, therefore, is an object of this invention to provide a stabilizer that is useful in every situation, that is adjustable and that can be essentially removed from operation altogether when not needed.

SUMMARY OF THE INVENTION

Accordingly, the stabilizer apparatus and method of the present invention includes according to one embodiment in a water craft, a stabilizer surface. A retractable arm is connected with the stabilizer surface and an extension/retractor is connected with the retractable arm for extending and retracting the retractable arm beneath the water craft.

According to a further aspect of the invention, the stabilizer is conformed to lay flat against a water craft hull when retracted. In a further aspect, the stabilizer is a planar surface connected at a center location of the planar surface to the retractable arm. In another aspect, the planar surface is a pentagon shaped planar surface with a leading end that comes to a point. In another aspect, a wedge extends from the retractable arm to the point and prevents debris from wrapping around the retractable arm. In another aspect, the retractable arm extends from within a water craft hull and includes water tight seals. In another aspect, the retractable arm is fitted within a housing and extends from and retracts into the housing. According to another aspect, the stabilizer is conformed to fit within a recess in a water craft hull. In another aspect, the extension/retractor includes a gear connected with the retractable arm for extending and retracting the retractable arm. In a further aspect, the extension/retractor includes a motor connected with the retractable arm for extending and retracting the retractable arm.

According to another embodiment of the invention, in a water craft with a hull and an interior and an exterior, a stabilizer apparatus includes a stabilizer surface. A retractable arm is located in the interior of the hull and is connected with the stabilizer surface. An extension/retractor is connected with the retractable arm for extending and retracting the retractable arm from the interior to the exterior of the hull beneath said water craft.

In accordance with another aspect of the invention, the stabilizer is conformed to lay flat against the exterior of the hull when retracted. In another aspect, the stabilizer is a planar surface connected at a center location of the planar surface to the retractable arm. In a further aspect, the planar surface is a pentagon shaped planar surface with a leading end that comes to a point. In another aspect, the retractable arm includes water tight seals. In a further aspect, the retractable arm is fitted within a housing and extends from and retracts into the housing. In a further aspect, the stabilizer is conformed to fit within a recess in said hull. In another aspect, the extension/retractor includes a gear connected with the retractable arm for extending and retracting the retractable arm. In a further aspect, the extension/retractor includes a motor connected with the retractable arm for extending and retracting the retractable arm.

According to another embodiment of the invention, in a water craft with a hull and an interior and an exterior, a stabilizer method includes the steps of: providing a stabilizer surface with a retractable arm located in the interior of the hull connected with the stabilizer surface and an extension/retractor connected with the retractable arm for extending and retracting the retractable arm from the interior to the exterior of the hull beneath the water craft; placing the water craft in water; and extending the stabilizer surface with the extension/retractor.

According to another aspect of the invention, a recess is provided within the hull such that the stabilizer fits within the recess when retracted.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
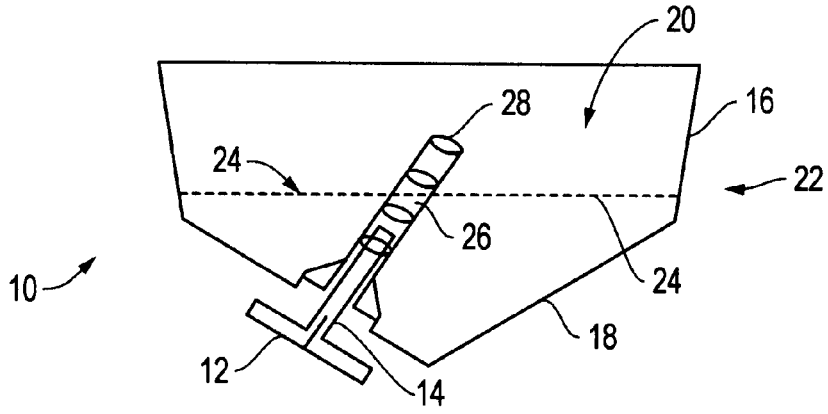
FIG. 1 is a front partial cross-section view of a water craft with a stabilizer apparatus according to one embodiment of the present invention shown in an extended position.

The preferred embodiment of the present invention is illustrated by way of example in FIGS. 1-5. With specific reference to FIGS. 1 and 2, the stabilizer apparatus 10 of the present invention includes a stabilizer surface 12 and a retractable arm 14 connected with stabilizer surface 12. Stabilizer 10, according to a preferred embodiment, is used in combination with a water craft 16. Water craft 16 is any water craft now known or hereafter developed and includes a hull 18, interior 20 and exterior 22. Water line 24 is represented by a dashed line that indicates the height of water on the hull 18 when water craft 16 is placed in water. As such, it is clear from the figures that stabilizer 10 extends and retracts from beneath the water craft 16, as will be discussed more fully hereafter.

Figure 2:
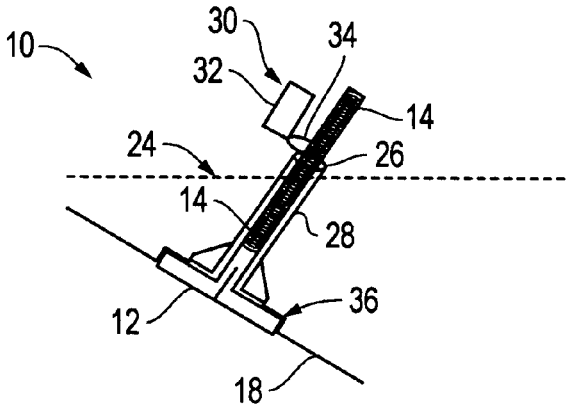
FIG. 2 is a front partial cross-section view of the invention of FIG. 1 showing an extension/retractor attached to the invention and in a retracted position.

FIGS. 1 and 2 show that retractable arm 14 extends from the interior 20 of water craft 16 through the hull 18. According to one embodiment, retractable arm 14 includes water tight seals 26. In another, retractable arm 14 fits within housing 28. In any case, retractable arm 14 and housing 28 extend above the water line 24. Without housing 28, water tight seals 26, rubber gaskets or any other water tight seal now known or hereafter developed, are located at the hull 18 where retractable arm 14 enters the water craft 16. With housing 28, the housing itself may form the water tight seal at hull 18. In any event, the combination of the water tight seals 26 and the housing 28 extending above the water line 24 on the interior 20 of water craft 16 ensures against leakage.

Referring now to FIG. 2, extensor/retractor 30 is shown connected with retractable arm 14. Extensor/retractor 30 includes, according to one embodiment, a motor 32 and gear 34. Gear 34 engages retractable arm 14 and moves retractable arm 14 in or out depending on the direction gear 34 is moved by motor 32. Gear 34 is any type of gear now known or hereafter developed for connecting with retractable arm 14 such as a worm gear or the like, all within the abilities of those of ordinary skill in the art and not disclosed or described further hereafter. Motor 32 may be electric or hydraulic or any combination now known or hereafter developed for turning gear 32. A manual handle (not shown) such as used with a common car jack may be used as well.

FIG. 1 shows the stabilizer 10 in a partially extended position away from the exterior 22 of hull 18 and illustrates a feature of the invention wherein the stabilizer apparatus 10 is capable of multiple useful positions such that a user is not limited to either a fully extended position or a fully retracted position but includes any useful positions in between. Thus, the user may adjust the stabilizer 10 to suit the circumstances and to find the most effective position according to each situation.

FIG. 2 illustrates another feature of the invention where a recess 36 is formed in hull 16 such that stabilizer surface 12 just fits within recess 36 when retractable arm 14 is in a fully retracted position as shown in FIG. 2. In this position, the stabilizer surface 12 fills the recess such that the exterior 22 of hull 18 presents an essentially uniform, uninterrupted surface.

Figure 3:
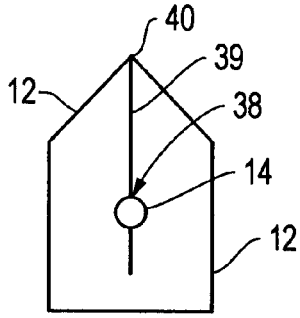
FIG. 3 is a top view of the planar stabilizer according to an embodiment of the invention.

Referring now to FIG. 3, the stabilizer surface 12 is illustrated according to one embodiment in which the stabilizer surface 12 is connected with retractable arm 14 at the approximate center 38 of stabilizer 12. According to another aspect of the invention, the stabilizer surface 12 is a planar surface in a pentagon shape. The pentagon comes to a point 40 which faces in the direction of the bow or front of the water craft 16. The Applicant has determined that while the point 40 is not critical to the effectiveness of the invention, it does help stabilize a water craft especially when the water craft is moving as it seems to reduce turbulence.

In another aspect of the invention, retractable arm 14 includes an extension 39 that is vertically plumb and connects with point 40 at an angle and along the surface of stabilizer surface 12. Thus, extension 39 forms wedge that prevents seaweed and other debris from wrapping around retractable arm 14. Instead, any debris will simply slide off as retractable arm 14 is retracted.

Figure 4:
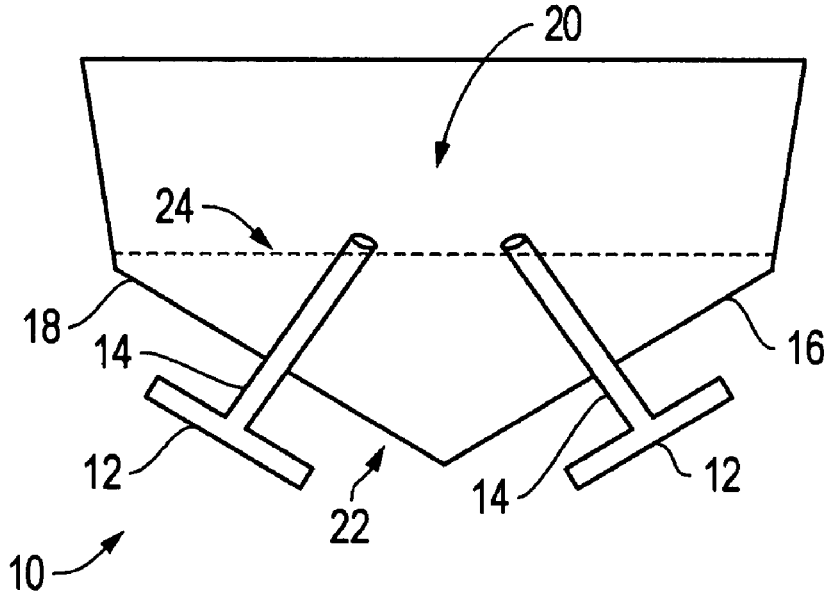
FIG. 4 is a front partial cross-section view of an embodiment of the invention with two stabilizer apparatus shown in an extended position.
Figure 5:
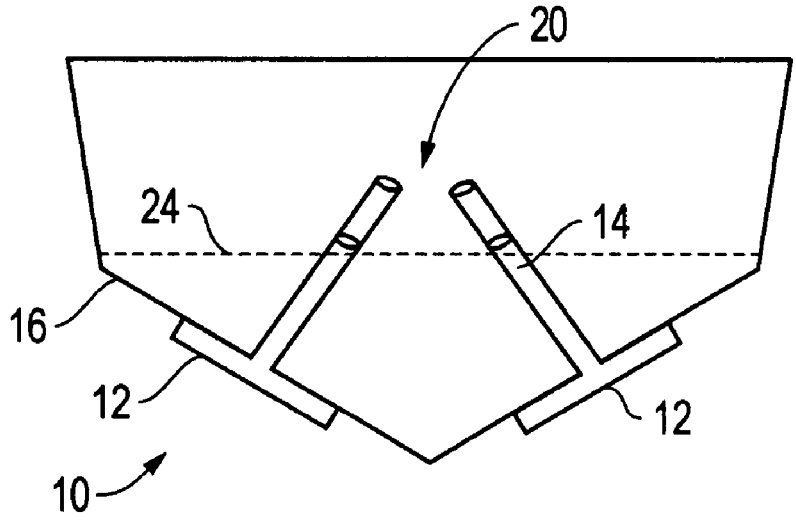
FIG. 5 is a front partial cross-section view of the invention of FIG. 4 shown in a retracted position.

Referring now to FIGS. 4 and 5, FIG. 4 shows the stabilizer apparatus 10 in the extended position and with a pair of the stabilizer apparatus 10 used, one on one side of the hull 18 and one on the opposite side of hull 18. It is anticipated that the use of stabilizer apparatus 10 in this manner, i.e. in oppositely positioned pairs, is the most common useful combination. Certainly the invention is not so limited and multiple stabilizers 10 in odd numbers are appropriate according to the invention as well.

FIG. 5 shows stabilizer apparatus 10 in the fully retracted position and with stabilizer surface 12 pulled tight against the exterior 22 of hull 18. This is a fully functional position and illustrates that there is no absolute need for the provision of recess 36. Thus, stabilizer apparatus 10 may be implemented with currently existing water craft as a retrofit as well as part of new construction.

In operation, the user floats his or her water craft and set off. Thereafter, whenever stability becomes an issue, either under weigh or at anchor, the stabilizer apparatus 10 may be used to reduce the motion of the water craft 16. All that is needed is to extend stabilizer surface 12 beneath the hull 18 until sufficient stabilizing effect is achieved. The distance the stabilizer surface 12 is extended is adjustable as conditions warrant. When stabilizer apparatus 10 is no longer needed, it is retracted against hull 18 either directly or into recess 36. Thereafter, stabilizer apparatus 10 is ready for reuse at any time and does not continue to affect the function of water craft 16.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. In a water craft, a stabilizer apparatus comprising:

a. a stabilizer surface wherein said stabilizer surface is a planar surface connected at a center location of said planar surface to a retractable arm;

b. said retractable arm connected with said stabilizer surface wherein said retractable arm includes a wedge-shaped extension connected with said stabilizer surface such that debris is prevented from wrapping around said retractable arm; and c. an extension/retractor connected with said retractable arm for extending and retracting said retractable arm beneath said water craft wherein said extension/retractor includes a gear engaged with said retractable arm and a motor engaged with said gear.

2. The apparatus of claim 1 wherein said stabilizer surface is conformed to lay flat against a water craft hull when retracted.

3. The apparatus of claim 1 wherein said planar surface is a pentagon shaped planar surface with a leading end that comes to a point.

4. The apparatus of claim 1 wherein said retractable arm extends from within a water craft hull and includes water tight seals.

5. The apparatus of claim 1 wherein said retractable arm is fitted within a housing and extends from and retracts into said housing.

6. The apparatus of claim 1 wherein said stabilizer surface is conformed to fit within a recess in a water craft hull.

7. In a water craft with a hull and an interior and an exterior, a stabilizer apparatus comprising:

a. a stabilizer surface wherein said stabilizer surface is a pentagon shaped planar surface with a leading end that comes to a point and wherein said stabilizer surface is a planar surface connected at a center location of said planar surface to a retractable arm;

b. said retractable arm located in the interior of said hull and connected with said stabilizer surface wherein said retractable arm includes a wedge-shaped extension extending between said retractable arm and said stabilizer surface point such that debris is prevented from wrapping around said retractable arm; and c. an extension/retractor connected with said retractable arm for extending and retracting said retractable arm from said interior to said exterior of said hull beneath said water craft wherein said extension/retractor includes a gear engaged with said retractable arm.

8. The apparatus of claim 7 wherein said stabilizer surface is conformed to lay flat against said exterior of said hull when retracted.

9. The apparatus of claim 7 wherein said retractable arm includes water tight seals.

10. The apparatus of claim 7 wherein said retractable arm is fitted within a housing and extends from and retracts into said housing.

11. The apparatus of claim 7 wherein said stabilizer surface is conformed to fit within a recess in said hull.

12. The apparatus of claim 7 wherein said extension/retractor includes a motor connected with said retractable arm for extending and retracting said retractable arm.

* * * * *